US007661532B2

(12) United States Patent
Conley et al.

(10) Patent No.: US 7,661,532 B2
(45) Date of Patent: Feb. 16, 2010

(54) TRAY INSERT FOR MEDICATION ON DEMAND DEVICE

(75) Inventors: N. Sharon Conley, Ormond Beach, FL (US); Bernard Boydston, Palm Bay, FL (US); Steven Dercole, Indiatlantic, FL (US); Rob Grillo, Rockledge, FL (US); Tim Reynolds, Valkaria, FL (US)

(73) Assignee: Avancen, LLC, Ormond Beach, FL (US)

( * ) Notice: Subject to any disclaimer, the term of this patent is extended or adjusted under 35 U.S.C. 154(b) by 54 days.

(21) Appl. No.: 11/858,502

(22) Filed: Sep. 20, 2007

(65) Prior Publication Data

US 2009/0078606 A1 Mar. 26, 2009

(51) Int. Cl.
*B65D 83/04* (2006.01)

(52) U.S. Cl. ..... 206/534; 221/2; 206/538; 206/536

(58) Field of Classification Search ..... 206/533, 206/538, 828, 536, 532, 531, 534; 221/2
See application file for complete search history.

(56) References Cited

U.S. PATENT DOCUMENTS 4,785,969 A * 11/1988 McLaughlin ..... 221/2
5,325,968 A * 7/1994 Sowden ..... 206/532
5,794,781 A * 8/1998 Roulin et al. ..... 206/531
6,234,343 B1 * 5/2001 Papp ..... 221/7
6,382,420 B1 * 5/2002 Bouthiette ..... 206/534
2004/0188313 A1 * 9/2004 Tedham ..... 206/531
2006/0144846 A1 * 7/2006 Varis ..... 221/2

* cited by examiner

*Primary Examiner*—Jacob K Ackun, Jr.
*Assistant Examiner*—Robert Poon
(74) *Attorney, Agent, or Firm*—John L. DeAngelis; Beusse Wolter Sanks Mora & Maire, P.A.

(57) ABSTRACT

In one embodiment, the invention comprises a tray insert for a medication dispenser, the dispenser permitting access to a medication dose after a minimum dosing interval has elapsed since presentation of an immediately previous dose. The dispenser comprises a dispenser cover having an opening through which a patient accesses the medication dose presented through the opening and a carousel for receiving the tray insert. The tray insert comprises a substrate, a plurality of medication retention areas in the substrate each for holding at least one medication dose, each medication retention area received within a depression of the carousel and a cover removably affixed to an upper surface of the substrate for retaining the medication doses in the medication retention areas prior to use, wherein after the tray insert is mated with the carousel the cover.

2 Claims, 5 Drawing Sheets

TRAY INSERT FOR MEDICATION ON DEMAND DEVICE

FIELD OF THE INVENTION

The present invention relates generally to a tray insert for mating with a carousel of a medication dispenser, the medication doses carried within the tray insert are accessible to the patient only at certain times to allow the patient to self-administer medication doses according to a prescribed dosing regimen.

BACKGROUND OF THE INVENTION

Fifty percent of post-operative patients report inadequate pain relief. Fifty percent of all cancer patients and ninety percent of advanced cancer patients experience pain. Pain is now defined as "the fifth vital sign" as part of the mandate by the Joint Commission on Accreditation of Healthcare Organizations (JCAHO) to develop guidelines for pain management.

Adequate pain control requires the appropriate medication for the pain level and pain type reported. In a hospital setting, pain medication can be obtained only by a physician's order. Pain medications such as narcotics and non-steroidal medications (and anxiety medications such as tranquilizers) are frequently ordered on an as-needed basis (referred to as pm orders). This approach requires the patient to initiate a request for each pm drug dose. The nurse determines whether the appropriate time interval has passed between doses, according to the physician's order. If the required time interval has elapsed the nurse transports the medication to the patient's bedside and administers the medication to the patient. In some dosing regimens, the patient is given a time-release pain medication at the same time(s) each day, with as-needed (pm) medications for breakthrough pain. Again, the patient must request the medication for each breakthrough pain episode. A common reported patient frustration is the need to issue a request for each and every dose of pm medication. Thus, a busy nurse must determine that the ordered time has elapsed from the last dosage, locate the medication and transport it to the patient in response to each request. This must also be accomplished in a timely fashion, as patients in pain must be administered to as soon as possible.

The as-needed prescription approach dispenses the minimum medication dose on a schedule that can control pain symptoms without the risk of abuse, overdosing or unnecessary side effects. Disadvantageously, in a hospital or institutional setting each medication that is dispensed on a pm basis requires nursing staff time and extra documentation by nursing and pharmacy staff, since the drugs can be administered only after the lapse of the predetermined time interval between doses. For example, a drug prescribed as needed every six hours may be given no more than four times in 24 hours. Such a drug may be administered from zero to four times in any given 24-hour period, depending upon patient dosage requests. If six hours have passed since the last administration of the drug, the medication is provided to the patient in response to the request. If six hours have not lapsed, the patient must wait the minimum time interval of six hours prior to receiving the next drug dose. In a home pm medication, dosing situation the patient must know when the previous dose was administered and await the prescribed interval before administering the next dose.

Improved patient pain control leads to better patient outcomes in the hospital setting. This has been well documented in the surgical literature in the post-operative setting, with fewer post-operative complications, earlier rehabilitation, and shorter hospital stays for patients with better pain management. Better pain management is also highly cost effective since earlier discharges and fewer complications save health care dollars and staff time.

BRIEF DESCRIPTION OF THE DRAWINGS

The foregoing and other features of the invention will be apparent from the following more particular description of the invention, as illustrated in the accompanying drawings, in which like reference characters refer to the same elements throughout the different figures. The figures are not necessarily to scale, emphasis instead being placed upon illustrating the principles of the invention.

DETAILED DESCRIPTION OF THE INVENTION

Before describing tray insert embodiments for use with a medication on demand dispenser, it should be observed that the specification describes and the drawings illustrate only those details that are pertinent to understanding the present invention without obscuring the disclosure with structural and functional details that will be apparent to those skilled in the art having the benefit of the description herein.

The following embodiments are not intended to define limits as to the structure, function or method of the invention embodiments, but only to provide exemplary constructions. The embodiments are permissive rather than mandatory and illustrative rather than exhaustive.

One embodiment of the tray insert described herein is intended for use with a medication on demand dispenser described and claimed in a commonly-owned issued patent entitled Patient Controlled Timed Oral Medication Dispenser, U.S. Pat. No. 7,044,302 issued on May 16, 2006, and medication on demand devices described and claimed in two pending non-provisional patent applications: a patent application assigned Ser. No. 11/125,299, filed on May 9, 2005 and entitled Patient Controlled Timed Medication Dispenser, and a patent application assigned Ser. No. 11/412,227, filed on Apr. 26, 2006 and entitled Patient Controlled Timed Medication Dispenser, all of which are incorporated by reference herein.

Figure 1:
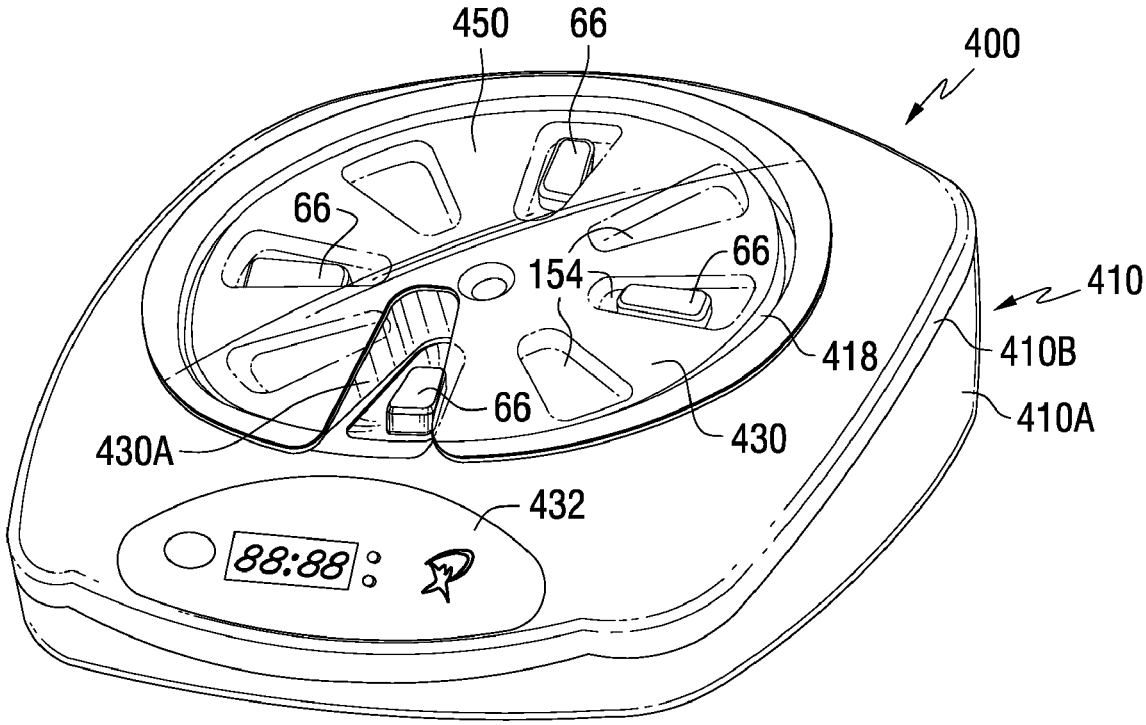
FIG. 1 illustrates an embodiment of a medication on demand dispenser device utilizing a tray insert of the present invention.

FIG. 1 illustrates an embodiment of a medication on demand dispenser (MOD) 400 including a carousel 418 (also referred to as a dispenser wheel) mated with a tray insert 450. The tray insert 450 carries the mediation doses 66 within medication retention areas 154 that fit within corresponding depressions in the carousel 418. In one embodiment, a diameter of a tray insert 450 and the carousel 418 is about 5 3/16 inches.

The medication on demand dispenser 400 further comprises a housing 410, comprising a lower housing section 410A and an upper housing section 410B. The housing 410 rotatably supports the carousel 418 and the mated tray insert 450. A MOD cover 430, in one embodiment having a substantially flat or slightly hemispherical shape and releasably attached to the housing 410, covers the carousel 418 and the tray insert 450 and prevents patient access to the medication doses 66. However, the MOD cover 430 defines an opening 430A defines an opening 430A therein through which a patient gains access to a single medication dose 66 when the carousel/tray insert assembly rotates to present a medication dose 66 at the opening 430A.

In different embodiments, the MOD cover 430 comprises transparent, translucent or opaque material. The former two embodiments allow visual inspection of the medication retention areas 154 and the medication dose 66 carried therein.

The carousel/tray insert assembly is controlled to rotate to align one of the medication retention areas 154 and its corresponding medication dose 66 with the cover opening 430A, allowing the patient to access and self-administer the medication dose. Carousel rotation is controlled according to the patient's dosing schedule so that medication doses are not available more frequently than the physician's pm order. Further details of the rotation control mechanisms are described in the above referenced patent and patent applications.

In one embodiment, the MOD cover 430 is lockably engaged to the upper housing section 410B. Unlocking the locking mechanism permits access to the carousel 418, the tray insert 450 and any medication doses 66 remaining in the dose retention areas 154 of the tray insert 450. In one embodiment, when in an unlocked configuration the cover 430 is completely removable from the upper housing section 410B. In another embodiment the cover 430 is hingably attached to the upper housing section 410B such that in the unlocked configuration the cover 430 swings open, pivoting on hinges (not shown in FIG. 1) to permit access to the carousel 418, the tray insert 450 and the medication doses 66.

Continuing with FIG. 1, within a region 432, the medication on demand device 400 further comprises various visual indicators indicating states and conditions of the device 400 and control elements for controlling operation of the device. These elements are described in the above referenced patent and patent applications.

Figure 2:
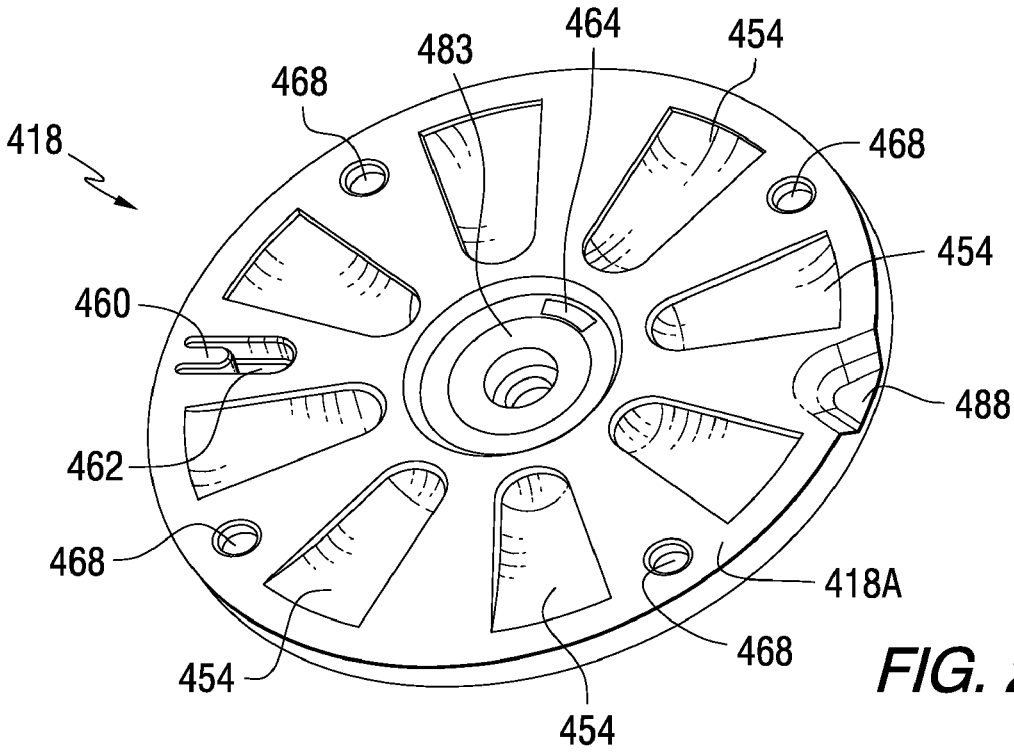
FIGS. 2, 3 and 4 illustrate different views of a carousel of the medication on demand dispenser device of FIG. 1.
Figure 3:
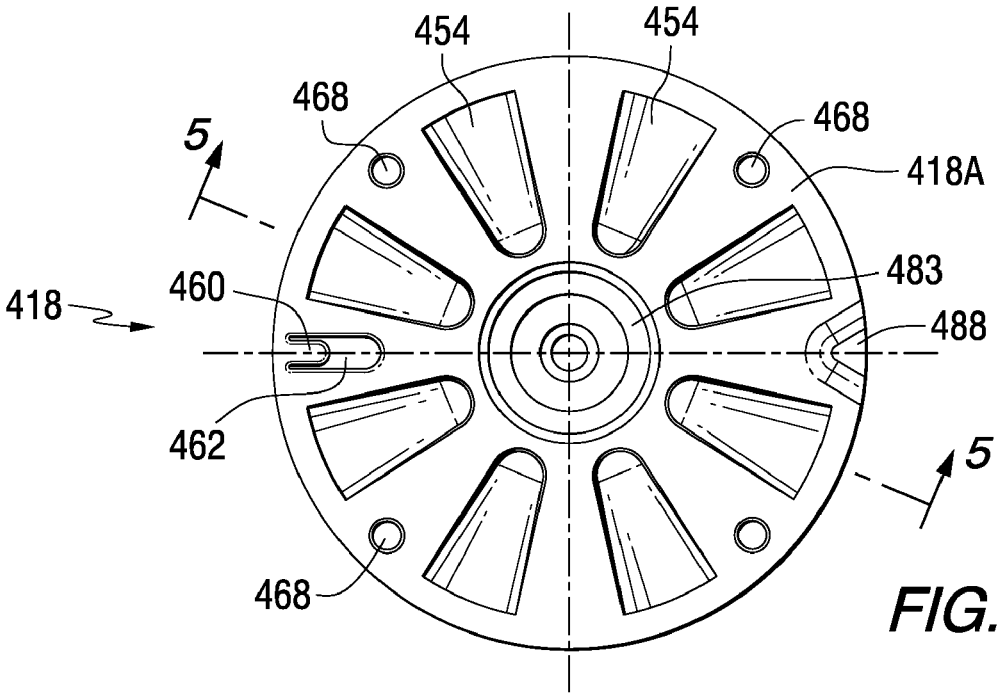
Figure 4:
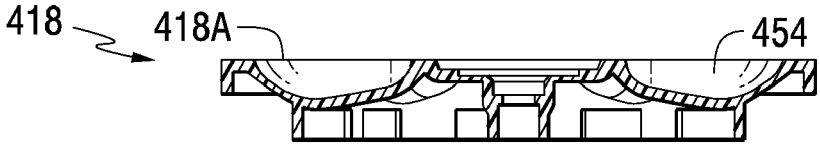

FIGS. 2, 3 and 4 illustrate respective isometric, top and cross-sectional views of one embodiment of the carousel 418. The carousel 418 comprises depressions 454 (for receiving the medication retention areas 154 of the tray insert 450) and a hold-down tab 460 having an upper surface substantially planar with an upper surface 418A of the carousel 418. An opening 462 is defined within the carousel 418 below the tab 460.

When the tray insert 450 is mated with the carousel 418, the carousel depressions 454 receive the tray insert medication retention areas 154. A notch 484 formed in a circumferential region of the tray insert 450 (see FIG. 5) slips into the opening 462 of the carousel 418. The carousel tab 460 exerts a downward force against a lower surface of the tray insert notch 484 to hold the tray insert 450 against the carousel's upper surface 418A. This force is especially beneficial to steady the tray insert 450 during removal of a tray insert cover (described further below) to expose the medication doses within the medication retention areas 154.

Returning to FIG. 2, the carousel 418 further comprises an indicia 464 (in one embodiment comprising an adhesive-backed machine or human readable label) affixed to a circular recess 483 or another region of the carousel 418. The indicia 464 may include a unique serial number to identify the medication on demand device 400 and to ensure that the MOD is correctly programmed with the dosing information for the assigned patient. This feature is especially beneficial when the MOD is programmed wirelessly, as use of the serial number during programming avoids programming another MOD that may be proximate the intended MOD.

Figure 6:
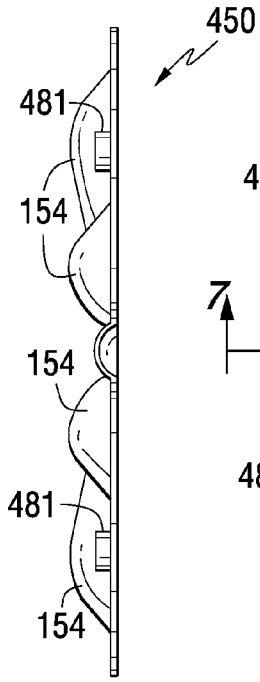
FIGS. 5, 6 and 7 illustrate different views of a first embodiment of the tray insert for mating with the carousel of the medication on demand device.
Figure 5:
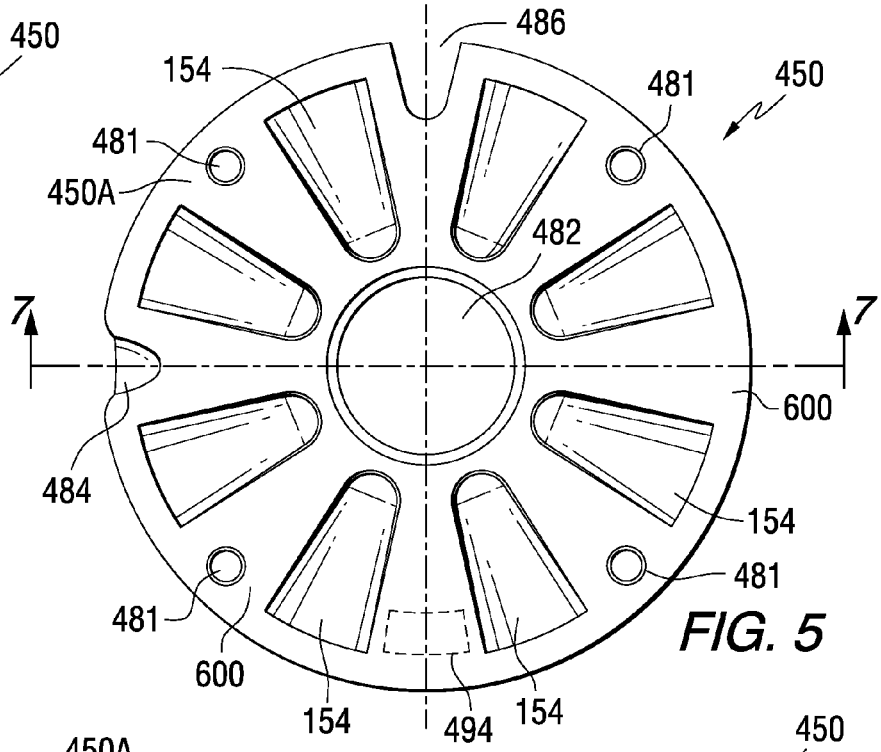
Figure 7:
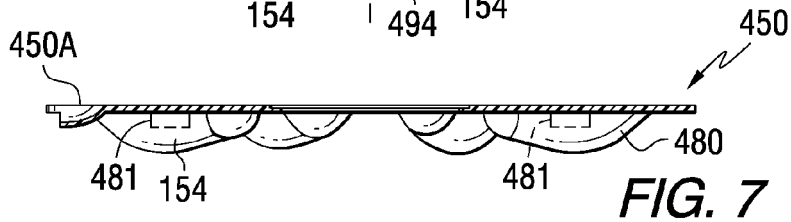

FIGS. 5, 6 and 7 illustrate a respective top, side and cross-sectional view of one embodiment of the tray insert 450 of the present invention. Generally, the shape and size of the tray insert 450 are substantially similar to the shape and size of the carousel 418.

One embodiment of the tray insert 450 comprises bosses 481 (see FIGS. 5 and 6) extending from a lower surface of the tray insert 450 and received within openings 468 (see FIGS. 2 and 3) of the carousel 418. Insertion of the tray insert bosses 481 into the carousel openings 468 ensures rotation of the tray insert 450 responsive to rotation of the carousel 418.

According to one embodiment a material of the tray insert 450 comprises a relatively light and formable clear, transparent, colored or opaque substantially rigid polyvinyl chloride film. In one embodiment the tray insert material is coated with polyvinylidene chloride having a thickness of about 0.01125 inches to ensure long term stability of the medication doses carried within the retention areas 154 of the tray insert 450. The coating protects against intrusion of water vapor and oxygen into the medication retention areas and is suitable for use with a variety of tray insert cover or lidding materials, including a peelable tray insert cover as described below.

As is known to those skilled in the art, other tray insert materials, coating materials and coating material thicknesses can be used to form the tray insert 450. For example, the tray insert 450 can be formed from styrene. Any material suitable for forming pharmaceutical-grade blister packaging can be used to form the tray insert 450.

The depicted embodiment comprises eight medication retention areas 154 each carrying a single medication dose 66 and each mating with a corresponding depression 454 in the carousel 418. Other embodiments may include fewer or more retention areas 154, and thus the carousel includes fewer or more depressions 454. In particular, a medication on demand device 400 for home or outpatient use may comprise about fifteen medication retention areas 154.

In one embodiment the tray insert 450 defines a recess 486 (see FIG. 5) for facilitating automated tray loading and counting when the tray insert 450 is automatically loaded with the medication doses.

Each medication tray insert 450 is disposable as it is intended for only a single use. When all the medication doses have been administered, the empty tray insert 450 is removed and a stocked tray insert is loaded into the MOD 400. To remove the tray insert 450 from the carousel 418, the MOD cover 430 is opened and the user slips his finger into a carousel recess 488 (see FIGS. 2 and 3) while simultaneously exerting a gentle upward force on the tray insert 450 and sliding the tray insert from beneath the carousel hold-down tab 460 (also illustrated in FIGS. 2 and 3).

Loading a stocked tray insert proceeds as follows. The tray insert notch 484 is placed into the carousel opening 462 such that the carousel's hold down tab 460 exerts a downward force against the bottom surface of the notch 484. The tray insert medication retention areas 154 are also received within the depressions 454 of the carousel 416. The tray insert cover (described below) is then removed and the MOD cover replaced and locked in a closed configuration.

Different tray insert covers may be applied to the stocked tray insert depending on the desired shelf life of the medication doses carried within the tray insert. Alternatively, a single tray insert cover may be used for all tray inserts, including those intended for short term and long term storage.

FIG. 6 illustrates a tray insert cover 490 preferably for use with relatively short shelf-life tray inserts, i.e., where long-term medication stability may not be important. Generally, the tray insert cover 490 is used for tray inserts that have a shelf life of a few days or weeks.

Figure 8:
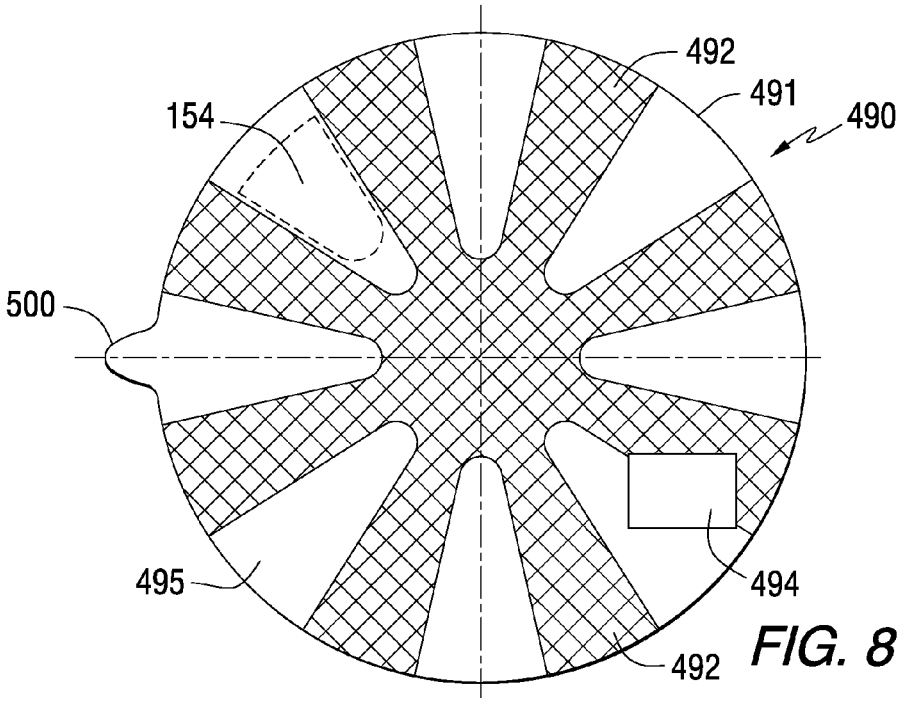
FIG. 8 illustrates a first embodiment of a tray insert cover for a tray insert of the present invention.

FIG. 8 depicts, exemplary adhesive sealing regions 492. Preferably, there is no adhesive film in the region of the cover tab 500, between spokes of the sealing regions 492 and intersecting medication retention regions 154. One medication retention area 154 is illustrated in FIG. 8 with dashed lines. As can be appreciated by those skilled in the art, in other embodiments different sealing regions may be used.

The tray insert cover 490 comprises multiple layers further comprising a laminate material layer 491, a first adhesive film forming sealing regions 492 (depicted using a cross-hatching symbol), a peelable paper backing material 493 (see FIG. 10) and a second adhesive film 495 disposed generally in areas where the first adhesive film is absent. The second adhesive film temporarily affixes the paper backing material 493 to the laminate material 491. The peelable paper backing material 493 protects the laminate material 491 and the sealing regions until applied to the upper surface of the tray insert 450.

Suitable laminate materials are known in the art; one suitable material is product number TPC-0777A available from Tolas Health Care Packaging of Feasterville, Pa. In the illustrated embodiment the laminate material 491 and the paper backing material 493 have substantially the same size and shape.

Figure 10:
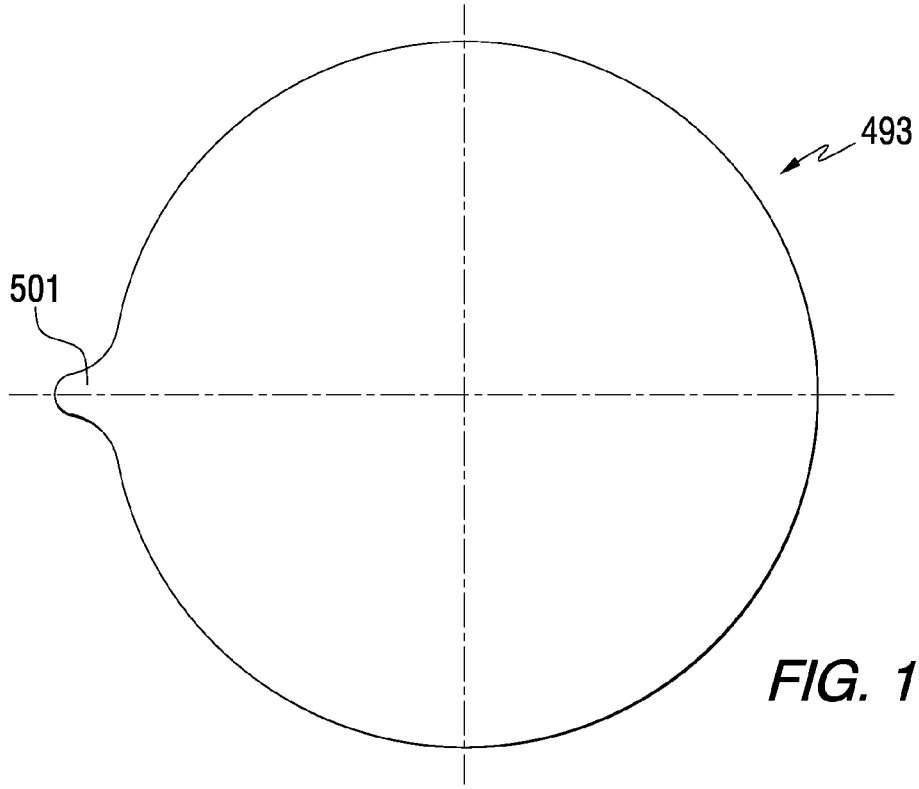
FIG. 10 illustrates a backing material layer for the first and the second embodiments of the tray insert cover.

After the medication doses have been loaded into the medication retention areas 154 of the tray insert 450, the paper backing 493 is removed from the laminate material 491 by separating the laminate and the paper backing starting at the cover tab 500 (illustrated in FIG. 8) and the backing material tab 501 (illustrated in FIG. 10). When completely separated, the laminate's adhesive-backed surface is placed on an upper surface of the loaded tray insert 450. Pressure is applied to the laminate material 491 by a roller or a finger to join the laminate material to the upper surface of the tray insert 450. The stocked tray inserts 450 are now suitable for storing or shipping.

It is noted that when the tray insert cover 490 is in place over the tray insert 450, the tray insert notch 484 is accessible to allow the carousel hold down tab 460 to be slipped into the notch 484. The hold down tab 460 steadies the tray insert 450 while the tray insert cover 490 is removed as described above.

Figure 9:
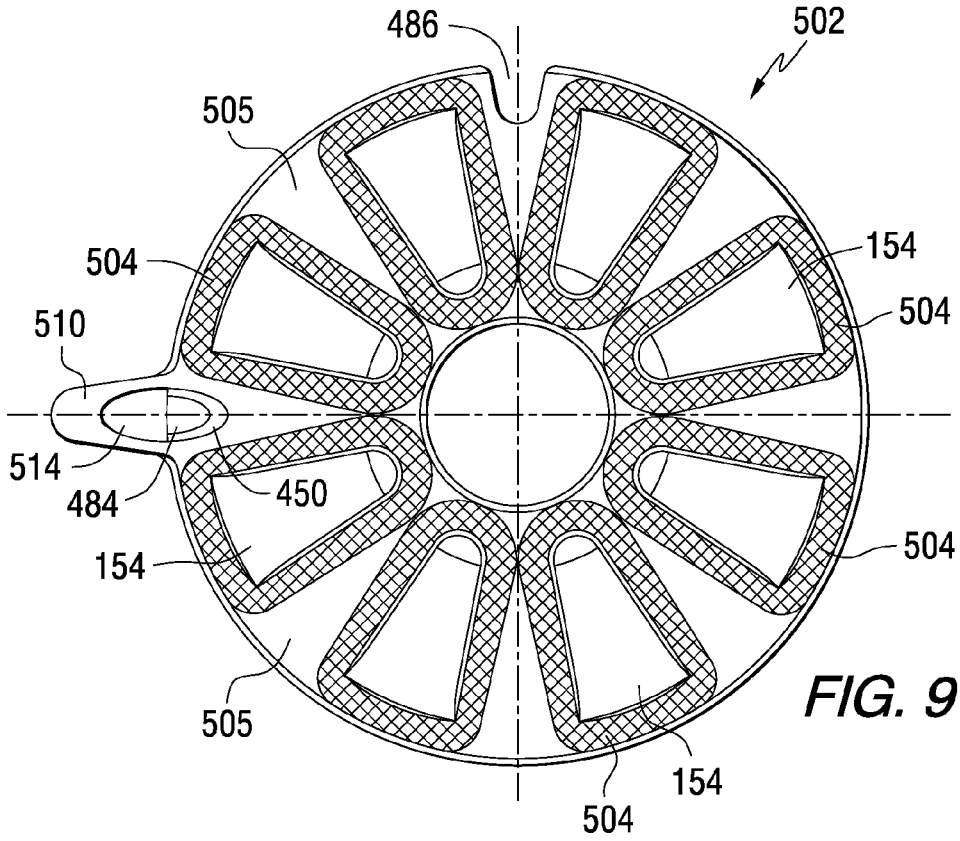
FIG. 9 illustrates a second embodiment of a tray insert cover for a tray insert of the present invention.

FIG. 9 illustrates a second embodiment of a tray insert cover 502 including seal regions 504 for sealing the cover 502 to an upper surface of the tray insert 450. The second embodiment may be better suited than the first embodiment for long term storage of the medication doses 66.

The tray insert cover 502 comprises a foil material having a first surface comprising a nitrocellulose material, for example. When the tray insert cover 502 is affixed to the tray insert 450, the cover's first surface is exposed. Also, when affixed to the tray insert 450, the tray insert cover 502 and the seal regions 504 individually seal the medication retention areas 154, creating a moisture and an air barrier for the medication doses 66. This configuration provides a relatively long-term shelf life (up to about two years) for the medication doses 66. Other cover materials and seal region configurations can be used with the tray insert 450.

The cover 502 comprises two adhesive regions typically formed by two different adhesive materials. The seal regions 504 encircling the medication retention areas 154 comprise a first adhesive that individually seals the medication retention areas 154, preventing the intrusion of environmental effects (such as air and water) to the medication doses 66. In one embodiment the first adhesive is activated by the application of heat and pressure. Second adhesive regions 505, formed from a second adhesive material having less adhesive binding strength than the first adhesive, comprises a universal sealant material disposed in areas of the cover 502 other than the seal regions 504. A combination of the first and the second adhesive materials bonds the cover 502 to the tray insert upper surface.

FIG. 9 also illustrates elements of the tray insert 450 and the cover 502 that hold the tray insert 450 in the carousel 418. The cover 502 comprises a tab 510 having an opening 514 formed therein. A portion of the tray insert 450 is visible through the opening 514 in FIG. 9. The visible portion includes the tray insert notch 484 which slides under the hold down tab 460 (not shown) when the tray insert/cover assembly is mated with the carousel 418.

The cover 502 is removable from the tray insert upper surface when the tray insert is mated with the carousel. Like the cover 490 of FIG. 8, when the tray insert cover 502 is in place over the tray insert 450, the tray insert notch 484 is accessible to allow the carousel hold down tab 460 to be slipped into the notch 484. The hold down tab 460 steadies the tray insert 450 while the tray insert cover 502 is removed as described above.

Those skilled in the art can identify different cover materials and different adhesive materials for use with the tray insert cover 490 and 502.

Figure 11:
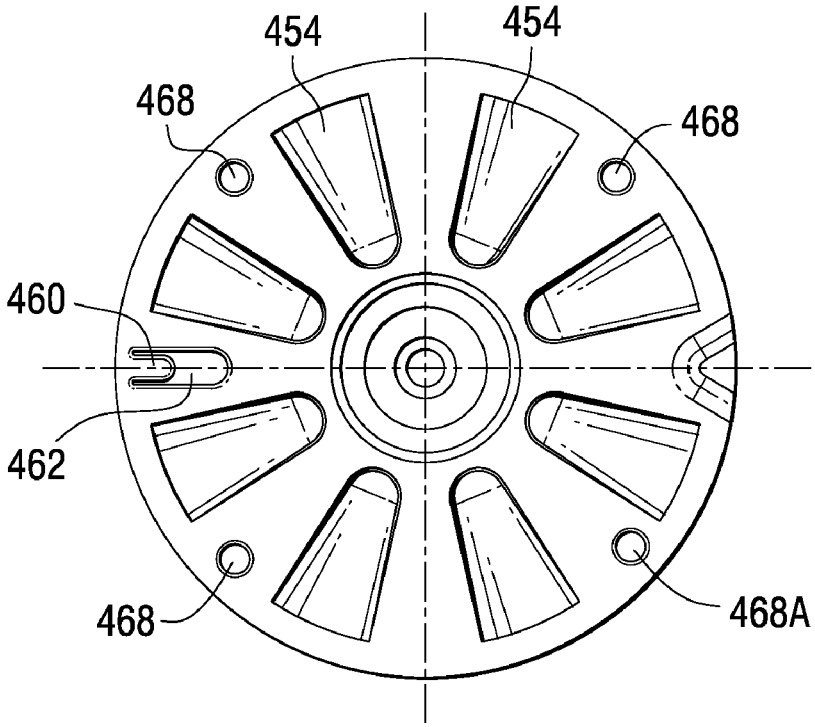
FIGS. 11 and 12 illustrate alternative embodiments of a carousel and a tray insert, respectively.
Figure 12:
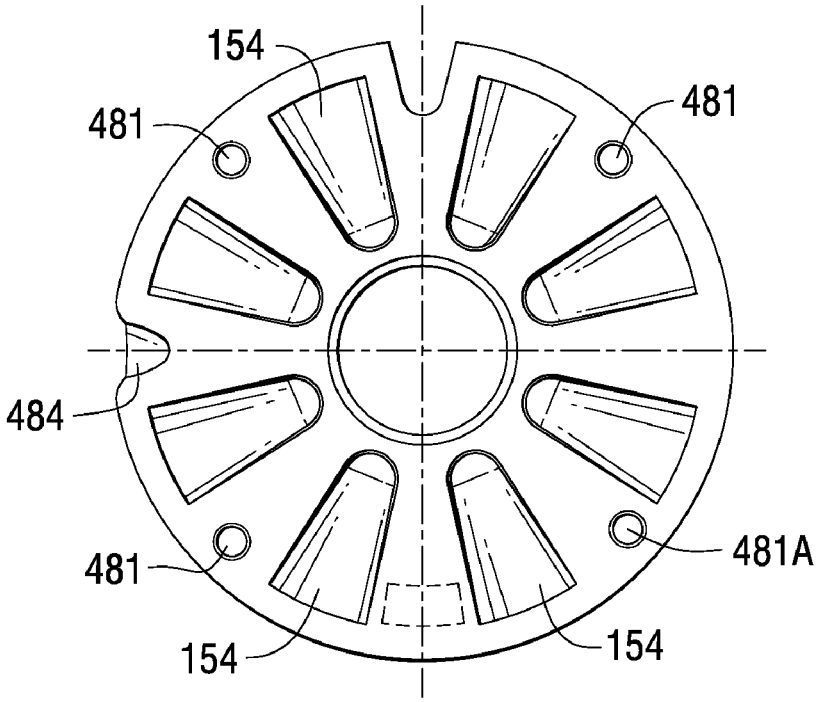

To properly dispense the medication doses 66, it is necessary to properly orient the tray insert 450 relative to the carousel 418. In one embodiment proper alignment is assured by sliding the tray insert notch 484 (see FIG. 5) under the carousel hold down tab 460 (see FIGS. 2 and 3). Alternatively, in another embodiment illustrated in FIGS. 11 and 12, a tray insert boss 481A (see FIG. 12) and corresponding carousel opening 468A (see FIG. 11) are asymmetrically located relative to the tray insert bosses 481 and the corresponding carousel openings 468. Thus the tray insert 450 and the carousel 418 can be mated in only one orientation. Either technique, as well as others, properly orients the tray insert 450 relative to the carousel 418.

Various information labels may be attached to the outside surface of the cover 490 and the cover 502. The information labels may include an expiration date of the medication doses carried by the tray insert 450 and a bar code indicating the intended patient, the medication dosage, the dosing regimen and the specific medication carried within the tray insert 450.

Returning to FIG. 8, the tray insert cover 490 (and the tray insert cover 502 of FIG. 9) carries a patient/medication indicia 494 (comprising, for example, a bar code or radio frequency identification (RFID) transmitter/receiver) that identifies the patient, the medication dose and the dosing schedule for the medications carried within the tray insert 450. The patient/medication indicia 494 can be read electronically or by a human attendant. The medication on demand device 400 comprises a bar code reader or a radio frequency identification interrogator for identifying the patient/medication as embodied in the patient/medication indicia 494. (The commonly-owned cited patent and patent applications describe these features of the medication on demand device in greater detail.)

In one embodiment, the information carried by the patient/medication indicia 494 is read by the MOD-based reader to program the MOD to administer the prescribed medication on the prescribed schedule.

Further, when an empty tray insert 450 is replaced with a stocked insert, the patient/medication information embodied in the patient/medication indicia 494 is determined (for example by machine or human reading of the indicia 494) and compared with the patient and medication information programmed into the MOD or indicated on a label affixed to the MOD. The comparison process ensures that the patient is receiving the correct medication on the correct dosing schedule.

In an embodiment where the patient/medication indicia 494 is carried on the tray insert cover 490/502, after the patient information is validated, the tray insert 450 is inserted into the carousel 418, the tray insert cover is removed as described above, the patient indicia 494 is removed from the cover 490/502 and placed in a transparent holder (not shown) of the MOD 400.

The medication retention areas 154 of the tray insert are manually or automatically stocked with the medication doses 66 in a suitable environment such as a pharmacy or by a pharmaceutical medication supplier. During the manual loading process, the tray insert 450 can be mated with a dispenser wheel that resembles the carousel 418 of FIGS. 2-4, but without the hold down tab 480, thereby allowing the tray insert 450 to drop into place in the dispenser wheel. A medication dose is manually placed in each of the medication retention areas 154. A medication loading machine performs automatic loading.

One embodiment of the medication on demand device with which the tray insert of the present invention is used can be controlled to present a blank area of the carousel/tray insert assembly through the opening 430A in the MOD cover 430 (see FIG. 1). A medication dose is presented at the opening 430A for a limited time after which the carousel/tray insert assembly is rotated by control elements to present a blank area 600 (see FIG. 5) at the opening 430A; the blank area 600 is disposed between adjacent tray insert medication retention areas 154. The blank area 600 remains at the opening 430A for a limited time after which the carousel/tray insert assembly is rotated according to the dosing schedule to present another medication dose at the opening 430A.

While the invention has been described with reference to preferred embodiments, it will be understood by those skilled in the art that various changes may be made and equivalent elements may be substituted for elements thereof without departing from the scope of the present invention. The scope of the present invention further includes any combination of the elements from the various embodiments as set forth herein. In addition, modifications may be made to adapt the teachings of the present invention to a particular application without departing from its essential scope thereof. Therefore, it is intended that the invention not be limited to the particular embodiment disclosed as the best mode contemplated for carrying out this invention nor to the other embodiments described and/or illustrated, but that the invention will include all embodiments falling within the scope of the appended claims.

What is claimed is:

1. A medication dispenser for dispensing medication doses, the medication dispenser comprising:

a housing;

a dispenser cover releasably or removably affixed to the housing, the dispenser cover having an opening through which a patient accesses a medication dose presented through the opening when the cover is in a closed position;

a carousel rotatably supported by the housing and controlled to permit access to a medication dose through the opening after a minimum dosing interval has elapsed since presentation of an immediately previous dose, the carousel receiving a tray insert carrying the medication doses, the tray insert comprising:

a circular disc having a plurality of medication retention areas therein, each medication retention area for holding at least one medication dose;

a tray insert cover removably affixed to an upper surface of the disc for retaining the medication doses in the medication retention areas, the tray insert cover removable from the upper surface to permit patient access to the medication doses when presented through the opening, means for positioning the tray insert relative to the carousel, comprising bosses extending from a bottom surface of the disc, each boss received within an opening in the carousel, wherein all of the bosses except at least one boss and all of the openings except one opening are symmetrically oriented relative to a center of the tray insert; and wherein rotation of the carousel is controlled to present a medication dose at the opening on a prescribed dosing schedule, and wherein the medication dose is presented at the opening for a predetermined time.

2. A medication dispenser for dispensing medication doses, the medication dispenser comprising:

a housing;

a dispenser cover releasably or removably affixed to the housing, the dispenser cover having an opening through which a patient accesses a medication dose presented through the opening when the dispenser cover is in a closed position;

a carousel rotatably supported by the housing and controlled to permit access to a medication dose through the opening after a minimum dosing interval has elapsed since presentation of an immediately previous dose, the carousel receiving a tray insert carrying the medication doses, the tray insert comprising:

a circular disc;

a plurality of medication retention areas in the disc each for holding at least one medication dose;

the disc configurable to a closed condition with a tray insert cover removably affixed to an upper surface of the disc for retaining the medication doses in the medication retention areas, the disc further configurable to an open condition with the tray insert cover removed to permit patient access to the medication doses when presented through the opening; and means for positioning the tray insert relative to the carousel, further comprising a central boss extending from a bottom surface of the disc received in an opening in the carousel, wherein the central boss is received within the opening according to a single configuration.

* * * * *